US005135546A

United States Patent [19]

Sato et al.

[11] Patent Number: 5,135,546

[45] Date of Patent: Aug. 4, 1992

[54] ABRASIVE TAPE

[75] Inventors: Masami Sato; Mitsuo Inoue, both of Kanagawa, Japan

[73] Assignee: Fuji Photo Film Co., Ltd., Kanagawa, Japan

[21] Appl. No.: 564,947

[22] Filed: Aug. 9, 1990

[30] Foreign Application Priority Data

Aug. 10, 1989 [JP] Japan ..... 1-207515

[51] Int. Cl.[5] ..... B24B 1/00

[52] U.S. Cl. ..... 51/295; 51/298; 51/307; 51/308; 51/309

[58] Field of Search ..... 51/295, 298, 307, 308, 51/309

[56] References Cited

U.S. PATENT DOCUMENTS

| | | | |
|---|---|---|---|
| 4,126,428 | 11/1978 | Rude | 51/295 |
| 4,138,229 | 2/1979 | Tadokoro et al. | 51/295 |
| 4,576,612 | 3/1986 | Shukla et al. | 51/295 |
| 4,762,534 | 8/1988 | Ito et al. | 51/309 |
| 4,767,644 | 8/1988 | Yamaguchi et al. | 51/298 |
| 4,832,705 | 5/1989 | Davies et al. | 51/309 |
| 4,842,618 | 6/1989 | Ito et al. | 51/295 |
| 4,922,675 | 5/1990 | Sato et al. | 51/295 |
| 5,011,512 | 4/1991 | Wald et al. | 51/295 |
| 5,028,242 | 7/1991 | Ito et al. | 51/309 |

*Primary Examiner*—William R. Dixon, Jr.
*Assistant Examiner*—Willie J. Thompson
*Attorney, Agent, or Firm*—Sughrue, Mion, Zinn, Macpeak & Seas

[57] ABSTRACT

An abrasive tape comprises a flexible substrate and an abrasive layer, which is overlaid on the flexible substrate and which is primarily constituted of abrasive grains and a binder. The abrasive grains are composed of first abrasive grains and second abrasive grains. The first abrasive grains and the second abrasive grains are constituted of at least one type of angular grains which are selected from the group consisting of $Cr_2O_3$, SiC, and $Al_2O_3$, and which are obtained from a pulverizing process. The mean grain diameter of the first abrasive grains falls within the range of 6 μm to 9 μm. The mean grain diameter of the second abrasive grains falls within the range of 4 μm to 6 μm. The binder is contained in a proportion falling within the range of 10% by weight to 30% by weight with respect to the abrasive grains. A 40% by weight to 65% by weight portion of the binder is constituted of a polyisocyanate.

4 Claims, 1 Drawing Sheet

ABRASIVE TAPE

BACKGROUND OF THE INVENTION

1. Field of the Invention

This invention relates to an abrasive tape to be used for the polishing of a magnetic head, or the like. This invention particularly relates to an abrasive tape to be used for the rough polishing of a surface of a magnetic head, or the like.

2. Description of the Prior Art

Magnetic heads for video tape recorders or for high-grade audio decks are made by being polished with abrasive tapes. The abrasive tape comprises a flexible substrate, and an abrasive layer overlaid on the flexible substrate. The abrasive layer is overlaid on the flexible substrate by applying an abrasive composition consisting of abrasive grains, a binder, additives, and the like onto the flexible substrate and drying the applied layer of the abrasive composition.

In general, when the surface of a magnetic head, or the like, is to be polished with the abrasive tape, two reels are positioned with the magnetic head or the like intervening therebetween, and the abrasive tape is moved in contact with the surface to be polished between two reels. The abrasive tape is flexible and can snugly fit to a curved surface. Therefore, the abrasive tape is more suitable for the polishing of the curved surface of the magnetic head, or the like, than grinding wheels. Also, the abrasive tape can achieve scratch-free, accurate polishing of the surface to be polished, and is therefore indispensable to the finish polishing of a rough-polished surface.

As is well known, processes for polishing a magnetic head with the abrasive tape comprise a rough polishing process, with which the tip of the magnetic head is shaped into a desired form, and a finish polishing process, with which the surface of the magnetic head is polished to a smooth finish. In the rough polishing process, a rough polishing tape, which is suitable for the rough polishing, is used. In the finish polishing process, a finish polishing tape, which is suitable for the finish polishing, is used. As the finish polishing tape, polishing tapes disclosed in, for example, Japanese patent publication Nos. 53(1978)-44174 and 62(1987)10782 have heretofore been used.

The rough polishing tape, which is used to shape the tip of a magnetic head into a desired form, should have good polishing performance and should be capable of quickly shaping the tip of a magnetic head into a desired form. Also, the rough polishing tape should not deeply scratch the surface of the magnetic head.

If the rough polishing performance is bad, a long time will be required for a magnetic head to be polished, and therefore the productivity during the rough polishing process will become low. If the rough polishing tape deeply scratches the surface of the magnetic head, a long time will be required for the deep scratches to be eliminated during the subsequent finish polishing process, and therefore the productivity during the finish polishing process will become low. Also, larger amounts of polishing tapes will be required during the rough polishing process and the finish polishing process. This is not advantageous from the viewpoint of economy.

In order for the polishing performance to be improved, the diameters of the abrasive grains contained in the abrasive layer of the abrasive tape should be increased. On the other hand, in order that the abrasive tape does not deeply scratches the surface of a magnetic head, the diameters of the abrasive grains contained in the abrasive layer of the abrasive tape should be decreased. Therefore, the requirement with respect to the polishing performance and the requirement with respect to the elimination of the deep scratching of the surface of a magnetic head are incompatible with each other. Accordingly, one of the two incompatible requirements must have heretofore been sacrificed, or a rough polishing tape having intermediate characteristics must have heretofore been used. A rough polishing tape having satisfactory characteristics cannot be obtained merely by the control of the diameters of the abrasive grains. Japanese patent publication No. 62(1987)-10782 discloses a method wherein an abrasive layer is constituted of a mixture of hard abrasive grains $Cr_2O_3$ and soft $\alpha$-$Fe_2O_3$ abrasive grains. With the disclosed method, the smoothness of a polished surface of a magnetic head can be improved. However, with the disclosed method, because the soft $\alpha$-$Fe_2O_3$ abrasive grains are used the polishing performance becomes markedly bad. Therefore, the disclosed method is not suitable for the rough polishing process.

SUMMARY OF THE INVENTION

The primary object of the present invention is to provide an abrasive tape, which has good polishing performance and which does not deeply scratches a surface to be polished.

Another object of the present invention is to provide an abrasive tape which is suitable for a rough polishing process.

The present invention provides an abrasive tape comprising a flexible substrate and an abrasive layer, which is overlaid on the flexible substrate and which is primarily constituted of abrasive grains and a binder, wherein said abrasive grains are composed of first abrasive grains and second abrasive grains, said first abrasive grains and said second abrasive grains being constituted of at least one type of angular grains which are selected from the group consisting of $Cr_2O_3$, SiC, and $Al_2O_3$, and which are obtained from a pulverizing process, the mean grain diameter of said first abrasive grains falls within the range of 6 $\mu$m to 9 $\mu$m, the mean grain diameter of said second abrasive grains falls within the range of 4 $\mu$m to 6 $\mu$m, said binder is contained in a proportion falling within the range of 10% by weight to 30% by weight with respect to said abrasive grains, and a 40% by weight to 65% by weight portion of said binder is constituted of a polyisocyanate.

With the abrasive tape in accordance with the present invention, the first abrasive grains having the mean grain diameter falling within the range of 6 $\mu$m to 9 $\mu$m contribute to good polishing performance. Also, by virtue of the second abrasive grains having the mean grain diameter falling within the range of 4 $\mu$m to 6 $\mu$m, it is possible to prevent the polished surface from being deeply scratched without the polishing performance of the abrasive tape becoming bad. Specifically, it is presumed that the first abrasive grains, which are hard and which have large grain diameters, achieve good polishing performance. Also, it is presumed that slightly deep scratches, which are generated by the first abrasive grains, are eliminated by the second abrasive grains having small grain diameters. In the present invention, the mean diameter of the abrasive grains is determined by use of a transmission electron microscope.

The first abrasive grains and the second abrasive grains have angular shapes and are obtained by pulverizing raw ingots. By way of example, WA#2000, WA#2500, WA#3000, and GC#2000, which are supplied by Fujimi Kenmazai Kogyo K.K., may be employed as the first abrasive grains and the second abrasive grains.

The abrasive grains having angular shapes have better polishing performance than abrasive grains having round shapes (e.g. CAH-3020 and CAH-3000 supplied by Sumitomo Chemical Co., Ltd.).

Also, with the abrasive tape in accordance with the present invention, the grain diameters of the abrasive grains fall within the specific ranges. Therefore, both the polishing performance and the smoothness of the polished surface can be kept good.

The materials of the abrasive grains employed in the abrasive tape in accordance with the present invention are selected from the group consisting of $Cr_2O_3$, SiC, and $Al_2O_3$. These materials are hard and have a Mohs hardness higher than 8.0, and therefore are suitable as the abrasive grains contained in the rough polishing tape. On the other hand, $\alpha$-$Fe_2O_3$ abrasive grains, $TiO_2$ abrasive grains, and $CaCO_3$ abrasive grains are soft and have a Mohs hardness lower than 6.5. Therefore, these abrasive grains have bad polishing performance and are not suitable as the abrasive grains contained in the rough polishing tape, which is required to have good polishing performance.

In the abrasive tape in accordance with the present invention, a 40% by weight to 65% by weight portion of the binder is constituted of a polyisocyanate. This feature contributes to good polishing performance and the prevention of the surface to be polished from being scratched deeply. Specifically, the binder comprising a resin having a polar group, which is highly reactive, and the polyisocyanate, which constitutes 40% by weight to 65% by weight of the total amount of the binder, forms a satisfactory network and yields a hard, tough abrasive layer. The hard abrasive layer contributes to good polishing performance, and the tough abrasive layer prevents the problem from occurring in that the abrasive grains separate from the abrasive layer and in that a surface to be polished is scratched deeply.

Additionally, the polyisocyanate, which constitutes 40% by weight to 65% by weight of the total amount of the binder, decreases the surface tension of the coating composition for the formation of the abrasive layer to an appropriate level. Therefore, the problem can be prevented from occurring in that the surface of the abrasive layer becomes rough due to the convection occurring when the coating composition, which has been applied onto the substrate, dries. Also, the polyisocyanate enhances the leveling effects of the coating composition. Accordingly, an abrasive layer having a smooth surface can be obtained. This feature also contributes to the prevention of the polished surface from being scratched deeply.

If the amount of the polyisocyanate used is smaller than 40% by weight of the total amount of the binder, an abrasive layer having a substantially smooth surface cannot be obtained. Also, a substantially hard abrasive layer cannot be obtained. As a result, sufficient effects cannot be obtained with respect to the prevention of the polished surface from being scratched deeply and with respect to the polishing performance. If the amount of the polyisocyanate used is larger than 65% by weight of the total amount of the binder, the toughness of the abrasive layer will become low. As a result, the abrasive grains will easily separate from the abrasive layer, and the separated abrasive grains will deeply scratch the surface to be polished.

In the abrasive tape in accordance with the present invention, the binder is contained in the abrasive layer in a proportion falling within the range of 10% by weight to 30% by weight with respect to the total amount of the first abrasive grains and the second abrasive grains, preferably in a proportion falling within the range of 15% by weight to 20% by weight with respect to the total amount of the first abrasive grains and the second abrasive grains. If the amount of the binder is smaller than 10% by weight with respect to the total amount of the first abrasive grains and the second abrasive grains, the abrasive grains will easily separate from the abrasive layer. As a result, the surface to be polished will be scratched deeply by the separated abrasive grains. Also, when the coating composition for the formation of the abrasive layer is applied by the doctor coating process, it cannot be applied uniformly. Therefore, defects, such as coating stripes, will occur.

If the amount of the binder is larger than 30% by weight with respect to the total amount of the first abrasive grains and the second abrasive grains, the abrasive grains will be embedded in the binder, and therefore good polishing performance cannot be obtained.

With the abrasive tape in accordance with the present invention, synergistic effects are obtained from the composition and the shapes of the abrasive grains and the composition of the binder. As a result, good polishing performance can be obtained, and the problem can be prevented from occurring in that the surface to be polished is scratched detrimentally.

The second abrasive grains should preferably be used in a proportion falling within the range of 10% by weight to 35% by weight with respect to the total amount of the first abrasive grains and the second abrasive grains. If the proportion of the second abrasive grains is smaller than 10% by weight with respect to the total amount of the first abrasive grains and the second abrasive grains, large effects of preventing the surface to be polished from being scratched deeply cannot be obtained. If the proportion of the second abrasive grains is larger than 35% by weight with respect to the total amount of the first abrasive grains and the second abrasive grains, the polishing performance will decrease slightly.

The first abrasive grains and the second abrasive grains are constituted of $Cr_2O_3$ grains, SiC grains, and/or $Al_2O_3$ grains, which are hard and have a Mohs hardness higher than 8.

In order that the dispersibility of the abrasive grains be kept good and the durability of the abrasive layer be kept high, the binder should preferably be constituted of a resin, which has at least one kind of polar group, and the polyisocyanate, which is employed as the curing agent and which constitutes 40% by weight to 65% by weight of the total amount of the binder.

As described above, with the abrasive tape in accordance with the present invention, synergistic effects are obtained from the composition of the abrasive grains and the composition of the binder. As a result, good polishing performance can be obtained, and the problem can be prevented from occurring in that the surface to be polished is scratched detrimentally. The features of the abrasive tape in accordance with the present invention are applicable not only to a rough polishing tape, but also to a semi-finish polishing tape and a finish polishing tape. As for the semi-finish polishing tape and the finish polishing tape, abrasive grains having mean grain diameters suitable for the respective purposes of polishing should be selected.

DESCRIPTION OF THE PREFERRED EMBODIMENTS

The present invention will hereinbelow be described in further detail with reference to the accompanying drawings.

Figure 1:
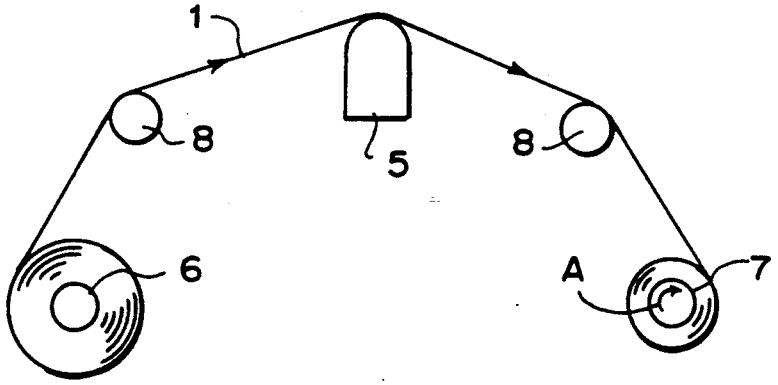
FIG. 1 is a schematic view showing an example of the polishing apparatus wherein the abrasive tape in accordance with the present invention is employed.
Figure 2:
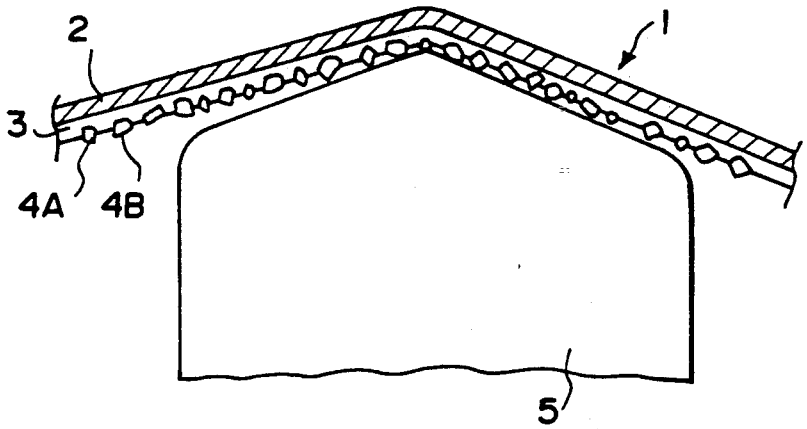
FIG. 2 is an enlarged view showing the abrasive tape and the magnetic head.

With reference to FIG. 1, a tape wind-up reel 7 is rotated in the direction indicated by the arrow A, and an abrasive tape 1 is fed from a tape feed roll 6 in the direction indicated by the arrow. The abrasive tape 1 is threaded over pass rolls 8, 8 so that it is contacted at a predetermined lap angle with a magnetic head 5 which is to be polished. In this manner, the surface of the magnetic head 5 on which the abrasive tape 1 slides is polished by the abrasive tape 1. As shown in FIG. 2, the abrasive tape 1 comprises a flexible substrate 2, which may be constituted of polyethylene terephthalate (PET), polyethylene-2,6-naphthalate or the like, and an abrasive layer 3 overlaid on the flexible substrate 2. The abrasive layer 3 slides on the magnetic head 5 and polishes it.

The abrasive layer 3 comprises first abrasive grains 4B having a mean grain diameter falling within the range of 6 μm to 9 μm, second abrasive grains 4A having a mean grain diameter falling within the range of 4 μm to 6 μm, and a binder or the like, which have been kneaded together and applied onto the flexible substrate 2.

The binder should have good dispersing quality in order to substantially disperse the first abrasive grains and the second abrasive grains in the abrasive layer 3 and adhere them to the abrasive layer 3. Also, additives such as a lubricant should preferably be added to the abrasive layer 3 so that the abrasive layer 3 exhibits good lubricity with respect to the magnetic head 5 and good movement stability. Preferable thicknesses of the abrasive layer 3 and the flexible substrate 2 vary depending on to what shape the magnetic head 5 is to be polished. In cases where the abrasive tape 1 is to be used for the finish polishing of an S-VHS system magnetic head, the thickness of the abrasive layer 3 should preferably be approximately 12 μm when the thickness of the flexible substrate 2 is 30 μm. Also, the thickness of the abrasive layer 3 should preferably be approximately 18 μm when the thickness of the flexible substrate 2 is 23 μm. If the thickness of the abrasive layer 3 is excessively large, the abrasive tape 1 cannot snugly fit to the magnetic head 5. Therefore, the thickness of the abrasive layer 3 should preferably be not larger than 50 μm.

Figure 3:
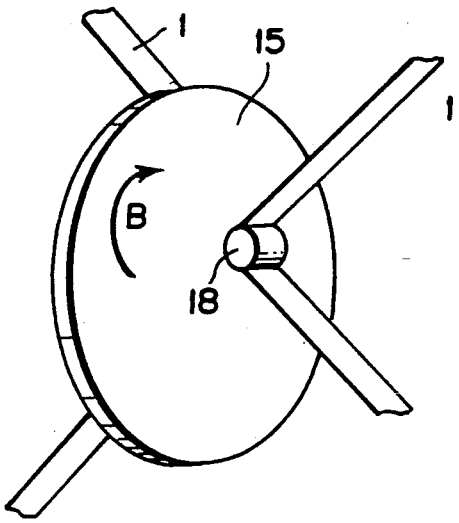
FIG. 3 is a schematic perspective view showing another example of the polishing apparatus wherein the abrasive tape in accordance with the present invention is employed.
Figure 4:
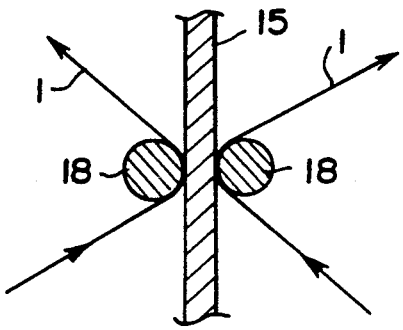
FIG. 4 is a sectional view of the polishing apparatus shown in FIG. 3.

The abrasive tape 1 in accordance with the present invention is suitable particularly for the polishing of a magnetic head having a high performance. However, the abrasive tape 1 in accordance with the present invention may also be used for polishing a hard disk 15 as shown in FIGS. 3 and 4. In cases where the hard disk 15 is to be polished, it is sandwiched between rubber rollers 18, 18, and the abrasive layers of the abrasive tapes 1, 1 are pushed by the rubber rollers 18, 18 against both surfaces of the hard disk 15. The hard disk 15 is then rotated in the direction indicated by the arrow B so that both surfaces of the hard disk 15 are polished simultaneously. In this case, pushing force larger than the pushing force exerted to the magnetic head 1 shown in FIGS. 1 and 2 is given to the hard disk 15 which is to be polished. However, since each of the abrasive tapes 1, 1 in accordance with the present invention contains two types of the abrasive grains as described above and the binder, which is capable of yielding smooth polished surfaces, there is no risk of the hard disk 15 being scratched detrimentally.

The present invention will further be illustrated by the following non-limitative examples.

EXAMPLE 1

An abrasive coating composition was prepared by dispersing the composition described below with a ball mill. The abrasive coating composition was applied onto a flexible, 23 μm-thick polyethylene terephthalate (PET) substrate web so that the thickness of the layer of the applied abrasive coating composition was 14 μm. The applied abrasive coating composition was then dried. In this manner, an abrasive layer was formed on the flexible substrate web. The flexible substrate web was then wound up, and slit into ½ inch widths. In this manner, an abrasive tape was made. The term "parts" as used hereinbelow means parts by weight.

| Composition: | |
|---|---|
| First abrasive grains [$Al_2O_3$ grains having a mean grain diameter of 8.1 μm and a Mohs hardness of 9.0 (WA #2000 supplied by Fujimi Kenmazai Kogyo K.K.)] | 320 parts |
| Second abrasive grains [$Al_2O_3$ grains having a mean grain diameter of 4.0 μm and a Mohs hardness of 9.0 (WA #3000 supplied by Fujimi Kenmazai Kogyo K.K.)] | 80 parts |
| Polyvinyl chloride resin (having a vinyl chloride content of 87% by weight with respect to the total wieght of the polyvinyl chloride resin, a number-average molecular weight of $2.6 \times 10^4$, an epoxy group content of 3.5% by weight with respect to the total weight of the polyvinyl chloride resin, and a sodium sulfonate group content of 0.5% by weight with respect to the total weight of the polyvinyl chloride resin) | 19.8 parts |
| Sulfonic acid group-containing polyurethane resin (having a molecular weight of 25,000 per $—SO_3H$ group) | 27.6 parts |
| Polyisocyanate (which was used in the form of an ethyl acetate solution containing a product of reaction of 3 mols of a 2,4-tolylene diisocyanate compound with 1 mol of trimethylolpropane in a concentration of 75% by weight) | 66.7 parts |
| Methyl ethyl ketone | 140 parts |

-continued

| Composition: | |
|---|---|
| Cyclohexanone | 90 parts |

EXAMPLE 2

An abrasive tape was made under the same conditions as Example 1, except that, instead of WA#3000 being used, $Al_2O_3$ grains having a mean grain diameter of 5.5 μm and a Mohs hardness of 9.0 (WA#2500 supplied by Fujimi Kenmazai Kogyo K.K.) were used as the second abrasive grains.

COMPARATIVE EXAMPLE 1

An abrasive tape was made under the same conditions as Example 1, except that the amount of the second abrasive grains (WA#3000) was changed to 0 part.

COMPARATIVE EXAMPLE 2

An abrasive tape was made under the same conditions as Example 1, except that the amount of the first abrasive grains (WA#2000) was changed to 0 part.

COMPARATIVE EXAMPLE 3

An abrasive tape was made under the same conditions as Example 1, except that the amount of the polyvinyl chloride resin was changed from 19.8 parts to 26 parts, the amount of the sulfonic acid group-containing polyurethane resin was changed from 27.6 parts to 36.4 parts, and the amount of the polyisocyanate was changed from 66.7 parts to 46.7 parts.

COMPARATIVE EXAMPLE 4

An abrasive tape was made under the same conditions as Example 1, except that the amount of the polyvinyl chloride resin was changed from 19.8 parts to 23.9 parts, the amount of the sulfonic acid group-containing polyurethane resin was changed from 27.6 parts to 33.4 parts, and the amount of the polyisocyanate was changed from 66.7 parts to 53.3 parts.

COMPARATIVE EXAMPLE 5

An abrasive tape was made under the same conditions as Example 1, except that the amount of the polyvinyl chloride resin was changed from 19.8 parts to 13.5 parts, the amount of the sulfonic acid group-containing polyurethane resin was changed from 27.6 parts to 18.9 parts, and the amount of the polyisocyanate was changed from 66.7 parts to 86.7 parts.

COMPARATIVE EXAMPLE 6

An abrasive tape was made under the same conditions as Example 1, except that the amount of the polyvinyl chloride resin was changed from 19.8 parts to 11.4 parts, the amount of the sulfonic acid group-containing polyurethane resin was changed from 27.6 parts to 15.9 parts, and the amount of the polyisocyanate was changed from 66.7 parts to 93.3 parts.

COMPARATIVE EXAMPLE 7

An abrasive tape was made under the same conditions as Example 1, except that the amount of the polyvinyl chloride resin was changed from 19.8 parts to 5.7 parts, the amount of the sulfonic acid group-containing polyurethane resin was changed from 27.6 parts to 8.0 parts, and the amount of the polyisocyanate was changed from 66.7 parts to 19.2 parts.

COMPARATIVE EXAMPLE 8

An abrasive tape was made under the same conditions as Example 1, except that the amount of the polyvinyl chloride resin was changed from 19.8 parts to 8.1 parts, the amount of the sulfonic acid group-containing polyurethane resin was changed from 27.6 parts to 11.4 parts, and the amount of the polyisocyanate was changed from 66.7 parts to 27.4 parts.

COMPARATIVE EXAMPLE 9

An abrasive tape was made under the same conditions as Example 1, except that the amount of the polyvinyl chloride resin was changed from 19.8 parts to 24.4 parts, the amount of the sulfonic acid group-containing polyurethane resin was changed from 27.6 parts to 34.1 parts, and the amount of the polyisocyanate was changed from 66.7 parts to 82.1 parts.

COMPARATIVE EXAMPLE 10

An abrasive tape was made under the same conditions as Example 1, except that the amount of the polyvinyl chloride resin was changed from 19.8 parts to 28.4 parts, the amount of the sulfonic acid group-containing polyurethane resin was changed from 27.6 parts to 39.8 parts, and the amount of the polyisocyanate was changed from 66.7 parts to 95.8 parts.

COMPARATIVE EXAMPLE 11

An abrasive tape was made under the same conditions as Example 1, except that the amount of the first abrasive grains was changed from 320 parts to 380 parts, and the amount of the second abrasive grains was changed from 80 parts to 20 parts.

COMPARATIVE EXAMPLE 12

An abrasive tape was made under the same conditions as Example 1, except that the amount of the first abrasive grains was changed from 320 parts to 360 parts, and the amount of the second abrasive grains was changed from 80 parts to 40 parts.

COMPARATIVE EXAMPLE 13

An abrasive tape was made under the same conditions as Example 1, except that the amount of the first abrasive grains was changed from 320 parts to 260 parts, and the amount of the second abrasive grains was changed from 80 parts to 140 parts.

COMPARATIVE EXAMPLE 14

An abrasive tape was made under the same conditions as Example 1, except that the amount of the first abrasive grains was changed from 320 parts to 240 parts, and the amount of the second abrasive grains was changed from 80 parts to 160 parts.

COMPARATIVE EXAMPLE 15

An abrasive tape was made under the same conditions as Example 1, except that, instead of 320 parts of WA#2000 being used as the first abrasive grains, 160 parts of WA#2000 and 160 parts of SiC abrasive grains having a mean grain diameter of 8.0 μm and a Mohs hardness of 9.5 (GC#2000 supplied by Fujimi Kenmazai Kogyo K.K.) were used.

COMPARATIVE EXAMPLE 16

An abrasive tape was made under the same conditions as Example 1, except that, instead of 320 parts of WA#2000being used as the first abrasive grains, 320 parts of $Al_2O_3$ abrasive grains having a mean grain diameter of 7.3 μm and a Mohs hardness of 9.0 (CAH-3020 #2000 supplied by Sumitomo Chemical Co., Ltd.) were used.

COMPARATIVE EXAMPLE 17

An abrasive tape was made under the same conditions as Example 1, except that, instead of 320 parts of WA#2000 being used as the first abrasive grains, 320 parts of $Al_2O_3$ abrasive grains having a mean grain diameter of 16.2 μm and a Mohs hardness of 9.0 (WA#1000 supplied by Fujimi Kenmazai Kogyo K.K.) were used.

COMPARATIVE EXAMPLE 18

An abrasive tape was made under the same conditions as Example 1, except that, instead of 80 parts of WA#3000 being used as the second abrasive grains, 80 parts of $Al_2O_3$ abrasive grains having a mean grain diameter of 3.0 μm and a Mohs hardness of 9.0 (WA#4000 supplied by Fujimi Kenmazai Kogyo K.K.) were used.

COMPARATIVE EXAMPLE 19

An abrasive tape was made under the same conditions as Example 1, except that, instead of 80 parts of WA#3000 being used as the second abrasive grains, 80 parts of $CaCO_3$ abrasive grains having a mean grain diameter of 4.2 μm and a Mohs hardness of 3.0 (Whiton P-30 supplied by Shiraishi Kogyo K.K.) were used.

Table 1 shows the compositions of the abrasive layers of the abrasive tapes made by Examples 1 and 2 and Comparative Examples 1 through 19.

Each of the rough polishing abrasive tapes made by Examples 1 and 2 and Comparative Examples 1 through 19 was set in a polishing apparatus, and a ferrite video head (magnetic head) was polished with the abrasive tape. Thereafter, the depths of polishing of the magnetic heads were measured. The rough polishing of the magnetic heads was carried out under the same polishing conditions for all of the abrasive tapes. The difference between the height of the magnetic head prior to the polishing and the height thereof after the polishing was finished was measured and taken as the depth of polishing. Thereafter, depths of scratches, which occurred in the surfaces of the magnetic heads due to the rough polishing, were investigated in the manner described below. Specifically, the finish polishing of each magnetic head was carried out for 20 seconds with the finish polishing abrasive tape disclosed in Example 1 of Japanese Unexamined patent Publication No. 60(1985)-232503. The number of deep scratches still remaining after the finish polishing was finished was counted. For this purpose, the surface of each magnetic head was observed through a microscope, and scratches having a width of not smaller than 5 μm were counted. Also, the surface roughness (Ra) of the abrasive layer of each abrasive tape was measured at a cut-off value of 0.8mm, a stylus radius of 2 micron R, and a stylus speed of 0.3mm/sec.

Also, tensile tests were carried out on the abrasive tapes listed in Table 1 and the flexible substrates (polyethylene terephthalate) of the abrasive tapes with a universal tensile and compression testing machine (Model TOM200D supplied by Shinko Tsushin Kogyo K.K.). Young's moduli of the abrasive layers were then calculated from the results of the tensile tests.

The tensile tests were carried out at a rate of pulling of 50mm/minute for ½inch-wide, 5cm-long samples. The Young's modulus of each abrasive layer was calculated with the formula $$Sk = \frac{ST(tK + tB) - SBtB}{tK} \quad EK = \frac{Sk}{\epsilon}$$

where Sk denotes the tensile stress (in kg/mm²) at 0.5% elongation of the abrasive layer, ST denotes the tensile stress (in kg/mm²) at 0.5% elongation of the abrasive tape, SB denotes the tensile stress (in kg/mm²) at 0.5% elongation of the flexible substrate, tK denotes the thickness (in mm) of the abrasive layer, tT denotes the thickness (in mm) of the abrasive tape, tB denotes the thickness (in mm) of the flexible substrate, EK denotes the Young's modulus (in kg/mm²) at 0.5% elongation of the abrasive layer, and ϵdenotes the strain at 0.5% elongation of the abrasive layer.

Table 2 shows the results of the measurement.

TABLE 1

| | Abrasive grains | | | | | Ratio of | Ratio of |
|---|---|---|---|---|---|---|---|
| | First abrasive grains | | Second abrasive grains | | Ratio of second abrasive grains to | total binder solid content to | polyisocyanate solid content |
| Abrasive tape | Type | Mean grain dia. (μm) | Type | Mean grain dia. (μm) | total amount of abrasive grains (% by weight) | total amount of abrasive grains (% by weight) | to total binder solid content (% by weight) |
| Ex. 1 | WA #2000 | 8.1 | WA #3000 | 4.0 | 20 | 24 | 50 |
| Ex. 2 | WA #2000 | 8.1 | WA #2500 | 5.5 | 20 | 24 | 50 |
| Comp. Ex. 1 | WA #2000 | 8.1 | | | | 24 | 50 |
| Comp. Ex. 2 | | | WA #3000 | 4.0 | | 24 | 50 |
| Comp. Ex. 3 | WA #2000 | 8.1 | WA #3000 | 4.0 | 20 | 24 | 35 |
| Comp. Ex. 4 | WA #2000 | 8.1 | WA #3000 | 4.0 | 20 | 24 | 40 |
| Comp. Ex. 5 | WA #2000 | 8.1 | WA #3000 | 4.0 | 20 | 24 | 65 |
| Comp. Ex. 6 | WA #2000 | 8.1 | WA #3000 | 4.0 | 20 | 24 | 70 |
| Comp. Ex. 7 | WA #2000 | 8.1 | WA #3000 | 4.0 | 20 | 7 | 50 |
| Comp. Ex. 8 | WA #2000 | 8.1 | WA #3000 | 4.0 | 20 | 10 | 50 |
| Comp. Ex. 9 | WA #2000 | 8.1 | WA #3000 | 4.0 | 20 | 30 | 50 |
| Comp. Ex. 10 | WA #2000 | 8.1 | WA #3000 | 4.0 | 20 | 35 | 50 |
| Comp. Ex. 11 | WA #2000 | 8.1 | WA #3000 | 4.0 | 5 | 24 | 50 |
| Comp. Ex. 12 | WA #2000 | 8.1 | WA #3000 | 4.0 | 10 | 24 | 50 |
| Comp. Ex. 13 | WA #2000 | 8.1 | WA #3000 | 4.0 | 35 | 24 | 50 |
| Comp. Ex. 14 | WA #2000 | 8.1 | WA #3000 | 4.0 | 40 | 24 | 50 |
| Comp. Ex. 15 | WA #2000 | 8.1 | WA #3000 | 4.0 | 40 | 24 | 50 |
| | GC #2000 | 8.0 | | | | | |

TABLE 1-continued

| Abrasive tape | Abrasive grains: First abrasive grains Type | First abrasive grains Mean grain dia. (μm) | Second abrasive grains Type | Second abrasive grains Mean grain dia. (μm) | Ratio of second abrasive grains to total amount of abrasive grains (% by weight) | Ratio of total binder solid content to total amount of abrasive grains (% by weight) | Ratio of polyisocyanate solid content to total binder solid content (% by weight) |
|---|---|---|---|---|---|---|---|
| Comp. Ex. 16 | CAH-3020 | 7.3 | WA #3000 | 4.0 | 20 | 24 | 50 |
| Comp. Ex. 17 | WA #1000 | 16.2 | WA #3000 | 4.0 | 20 | 24 | 50 |
| Comp. Ex. 18 | WA #2000 | 8.1 | WA #4000 | 3.0 | 20 | 24 | 50 |
| Comp. Ex. 19 | WA #2000 | 8.1 | Whiton P-30 | 4.2 | 20 | 24 | 50 |

TABLE 2

| Examples | Ra of abrasive layer surface (μm) | Young's modulus of abrasive layer (kg/mm$^2$) | Number of scratches on surface of polished video head | Depth of polishing of video head (μm) |
|---|---|---|---|---|
| Ex. 1 | 1.001 | 224 | 0 | 51 |
| Ex. 2 | 1.012 | 230 | 0 | 53 |
| Comp. Ex. 1 | 1.150 | 232 | not less than 50 | 57 |
| Comp. Ex. 2 | 0.860 | 187 | 0 | 25 |
| Comp. Ex. 3 | 1.070 | 191 | 12 | 48 |
| Comp. Ex. 4 | 1.022 | 208 | 0 | 49 |
| Comp. Ex. 5 | 0.947 | 238 | 0 | 52 |
| Comp. Ex. 6 | 0.913 | 243 | 11 | 53 |
| Comp. Ex. 7 | 0.769 | 122 | 17 | 44 |
| Comp. Ex. 8 | 0.805 | 157 | 0 | 47 |
| Comp. Ex. 9 | 0.976 | 225 | 0 | 45 |
| Comp. Ex. 10 | 1.024 | 255 | 0 | 36 |
| Comp. Ex. 11 | 1.115 | 227 | 8 | 54 |
| Comp. Ex. 12 | 1.101 | 221 | 0 | 52 |
| Comp. Ex. 13 | 0.966 | 217 | 0 | 43 |
| Comp. Ex. 14 | 0.981 | 216 | 0 | 31 |
| Comp. Ex. 15 | 1.002 | 223 | 0 | 52 |
| Comp. Ex. 16 | 0.997 | 220 | 0 | 38 |
| Comp. Ex. 17 | 2.113 | 235 | 21 | 58 |
| Comp. Ex. 18 | 0.921 | 210 | 0 | 40 |
| Comp. Ex. 19 | 0.933 | 217 | 0 | 35 |

As is clear from Table 2 , with the abrasive tapes made by Examples 1 and 2 , the depth of polishing of the video head is large, and no deep scratches occur in the surface of the video head. Therefore, the abrasive tapes made by Examples 1 and 2 are suitable for the rough polishing. Unlike the abrasive tapes made by Comparative Examples 1 and 2 , the abrasive tapes made by Examples 1 and 2 contain both the first abrasive grains and the second abrasive grains in appropriate proportions. Therefore, the abrasive tapes made by Examples 1 and 2 exhibit both the good polishing performance of the first abrasive grains and large effects of the second abrasive grains with respect to the prevention of the surface to be polished from being scratched deeply.

From the comparison of the results of Example 1 with the results of Comparative Examples 3, 4, 5, and 6, it is revealed that, when the ratio of the polyisocyanate solid content to the total binder solid content falls within the range of 40% by weight to 65% by weight, the depth of polishing of the video head can be kept large, and the polished surface of the video head can be prevented from being scratched deeply. In cases where the ratio of the polyisocyanate solid content to the total binder solid content is lower than 40% by weight, the leveling effects of the polyisocyanate become insufficient, and the surface roughness (Ra) of the abrasive layer increases. As a result, deep scratches occur in the polished surface of the video head. In cases where the ratio of the polyisocyanate solid content to the total binder solid content is higher than 65% by weight, the abrasive layer becomes brittle due to the excess polyisocyanate, and the abrasive grains easily separate from the abrasive layer. As a result, due to the separated abrasive grains, the surface of the video head is scratched deeply.

From the comparison of the results of Example 1 with the results of Comparative Examples 7, 8, 9, and 10, it is revealed that, when the ratio of the total binder solid content to the total amount of the abrasive grains falls within the range of 10% by weight to 30% by weight, the depth of polishing of the video head can be kept large, and the polished surface of the video head can be prevented from being scratched deeply. In cases where the ratio of the total binder solid content to the total amount of the abrasive grains is lower than 10% by weight, the amount of the binder is insufficient, so that the abrasive grains easily separate from the abrasive layer. As a result, due to the separated abrasive grains, the surface of the video head is scratched deeply. In cases where the ratio of the total binder solid content to the total amount of the abrasive grains is higher than 30% by weight, the abrasive grains become embedded in the binder, and therefore the depth of polishing of the video head decreases.

From the comparison of the results of Example 1 with the results of Comparative Examples 11, 12, 13, and 14, it is revealed that, when the ratio of the amount of the second abrasive grains to the total amount of the abrasive grains falls within the range of 10% by weight to 35% by weight, the depth of polishing of the video head can be kept large, and the polished surface of the video head can be prevented from being scratched deeply. In cases where the ratio of the amount of the second abrasive grains to the total amount of the abrasive grains is lower than 10% by weight, the smooth polishing effects of WA#3000 cannot be obtained. In cases where the ratio of the amount of the second abrasive grains to the total amount of the abrasive grains is higher than 35% by weight, the polishing performance of WA#2000 cannot be obtained.

From the comparison of the results of Example 1 with the results of Comparative Example 15, it is revealed that, when a mixture of WA#2000 and GC#2000 is employed, instead of the first abrasive grains of Example 1 being employed, the abrasive tape made by Comparative Example 15 has the same effects as the abrasive tape made by Example 1 . This is because the mean grain diameter and the Mohs hardness in comparative example 15 are approximately the same as those in Example 1.

From the comparison of the results of Example 1 with the results of Comparative Example 16, it is revealed that the abrasive tape, which is made by Comparative Example 16 and which contains round grains as the first abrasive grains, yields a smaller depth of polishing of the video head than the abrasive tape, which is made by Example 1 and which contains angular grains as the first abrasive grains. Therefore, it is regarded that the abrasive grains having the angular shapes contribute to a large depth of polishing.

From the comparison of the results of Example 1 with the results of Comparative Example 17, it is revealed that the abrasive tape, which is made by Comparative Example 17 and which contains the first abrasive grains having a larger mean grain diameter than WA#2000, yields more scratches in the polished surface of the video head.

Also, from the comparison of the results of Example 1 with the results of Comparative Example 18, it is revealed that, when the abrasive tape, which is made by Comparative Example 18 and which contains the second abrasive grains having a smaller mean grain diameter than WA#3000, is used, the depth of polishing of the video head becomes markedly smaller than when the abrasive tape made by Example 1 is used.

From the comparison of the results of Example 1 with the results of Comparative Example 19 , it is revealed that, when the abrasive tape, which is made by Comparative Example 19 and which contains the soft $CaCO_3$ abrasive grains having a Mohs hardness of 3.0 second abrasive grains, is used, the depth of polishing of the video head becomes markedly smaller than when the abrasive tape made by Example 1 is used.

From the results of Comparative Examples 16, 17, 18, and 19, it is revealed that the first abrasive grains and the second abrasive grains, which have the mean grain diameters and the Mohs hardnesses defined in Examples 1 and 2 and Comparative Example 15, are suitable for use in the abrasive tape.

The abrasive tape in accordance with the present invention can be embodied in various other manners. Also, the term "abrasive tape" as used herein embraces not only the elongated tapes, but also disk-shaped media comprising a thin disk-shaped substrate and an abrasive layer overlaid on the substrate.

We claim:

1. An abrasive tape comprising a flexible substrate and an abrasive layer, which is overlaid on the flexible substrate and which is primarily constituted of abrasive grains and a binder, wherein said abrasive grains are composed of first abrasive grains and second abrasive grains, said first abrasive grains and said second abrasive grains being constituted of at least one type of angular grains which are selected from the group consisting of $Cr_2O_3$, SiC, and $Al_2O_3$ , and which are obtained from a pulverizing process, the mean grain diameter of said first abrasive grains falls within the range of 6 μm to 9 μm, the mean grain diameter of said second abrasive grains falls within the range of 4 μm to 6 μm, said binder is contained in a proportion falling within the range of 10% by weight to 30% by weight with respect to said abrasive grains, and a 40% by weight to 65% by weight portion of said binder is constituted of a polyisocyanate.

2. An abrasive tape as defined in claim 1 wherein said second abrasive grains are contained in a proportion falling within the range of 10% by weight to 35% by weight with respect to the total amount of said abrasive grains.

3. An abrasive tape as defined in claim 1 wherein said binder is contained in a proportion falling within the range of 15% by weight to 20% by weight with respect to said abrasive grains.

4. An abrasive tape as defined in claim 1 wherein said binder is constituted of a resin, which has at least one kind of polar group, and the polyisocyanate, which serves as a curing agent and which constitutes 40% by weight to 65% by weight of the total amount of said binder.

* * * * *